US007462804B2

(12) United States Patent
Shirakata et al.

(10) Patent No.: US 7,462,804 B2
(45) Date of Patent: Dec. 9, 2008

(54) INDUCTION IMAGE HEATING APPARATUS

(75) Inventors: Jiro Shirakata, Kashiwa (JP); Shouhei Takeda, Toride (JP); Koki Watanabe, Moriya (JP); Shinichiro Wakahara, Tokyo (JP); Koji Takematsu, Abiko (JP); Koichiro Nishimura, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/572,544

(22) PCT Filed: Dec. 22, 2004

(86) PCT No.: PCT/JP2004/019690

§ 371 (c)(1),
(2), (4) Date: Jul. 5, 2007

(87) PCT Pub. No.: WO2005/062133

PCT Pub. Date: Jul. 7, 2005

(65) Prior Publication Data

US 2008/0061054 A1 Mar. 13, 2008

(30) Foreign Application Priority Data

Dec. 24, 2003 (JP) ..... 2003-427808
Dec. 13, 2004 (JP) ..... 2004-359888

(51) Int. Cl.
*H05B 6/14* (2006.01)
*G03G 15/20* (2006.01)

(52) U.S. Cl. ..... 219/619; 219/649; 219/676; 399/328; 399/330

(58) Field of Classification Search ..... 219/619, 219/647, 649, 652, 670, 672–676; 399/328–335
See application file for complete search history.

(56) References Cited

U.S. PATENT DOCUMENTS

| | | | | |
|---|---|---|---|---|
| 6,021,303 | A * | 2/2000 | Terada et al. | 399/328 |
| 7,197,270 | B2 | 3/2007 | Kato et al. | 399/328 |
| 7,199,339 | B2 | 4/2007 | Shirakata et al. | 219/619 |
| 2005/0173415 | A1 | 8/2005 | Naoyouki et al. | 219/619 |
| 2006/0086721 | A1 | 4/2006 | Wakahara et al. | 219/619 |

(Continued)

FOREIGN PATENT DOCUMENTS

JP 59-33787 2/1984

(Continued)

OTHER PUBLICATIONS

Translation of Notification of the First Office Action in Chinese Patent Application No. 200480034304.4, dated Feb. 22, 2008.

*Primary Examiner*—Philip H Leung
(74) *Attorney, Agent, or Firm*—Fitzpatrick, Cella, Harper & Scinto

(57) ABSTRACT

In order to prevent non-sheet passing portion temperature rise occurred in a non-sheet passing area of an electromagnetic induction heating member 1, leakage of magnetic flux is reduced by setting a Curie temperature of the heating member 1 to be smaller than an acceptable upper limit temperature and setting a thickness of the heating member so that a thickness tk in a Curie temperature arrival area (P1–P2) is larger than a thickness tn in a Curie temperature non-arrival area P2 which is a conveyance area of a material to be heated having a minimum passing size.

20 Claims, 7 Drawing Sheets

U.S. PATENT DOCUMENTS

| | | | | |
|---|---|---|---|---|
| 2006/0086722 | A1 | 4/2006 | Takematsu et al. | 219/619 |
| 2006/0086725 | A1 | 4/2006 | Hosoi et al. | 219/619 |
| 2006/0089314 | A1 | 4/2006 | Wakahara et al. | 514/21 |
| 2006/0138126 | A1 | 6/2006 | Watanabe | 219/619 |

FOREIGN PATENT DOCUMENTS

| | | |
|---|---|---|
| JP | 3-56960 | 5/1991 |
| JP | 9-171889 | 6/1997 |
| JP | 9-306652 | 11/1997 |
| JP | 10-74009 | 3/1998 |
| JP | 10-166100 | 6/1998 |
| JP | 2000-39796 | 2/2000 |
| JP | 2000-39797 | 2/2000 |
| JP | 2001-267050 | 9/2001 |
| JP | 2001-318545 | 11/2001 |
| JP | 2003-123957 | 4/2003 |

* cited by examiner (a)

(b)

INDUCTION IMAGE HEATING APPARATUS

TECHNICAL FIELD

The present invention relates to a heating apparatus for heating a material to be heated and conveyed by heat generation of a heating element which is induction-heated, and an image forming apparatus using the heating apparatus.

BACKGROUND ART

Japanese Laid-Open Patent Application (JP-A) No. Sho 59-33787 has proposed an electromagnetic induction heating type heating apparatus utilizing high-frequency induction heating as a heating source.

In the heating apparatus, a coil is disposed concentrically in hollow fixation roller comprising a metal conductor (induction heating element). A high-frequency current is passed through the coil to generate a high-frequency magnetic field. The magnetic field generates an induction eddy current, whereby the fixing apparatus itself generates Joule heat due to its own skin resistance. According to the electromagnetic induction heating-type fixing apparatus, an electricity-heat conversion efficiency is significantly improved, so that it becomes possible to reduce a warm-up time.

However, such an electromagnetic induction heating-type fixing apparatus or passed is actuated so that the entire maximum-sized recording material which can be conveyed or passed as a material to be heated is heated at a predetermined fixing temperature to perform toner image fixation. For this reason, energy higher than that required for actual toner image fixation has been consumed. Further, when the recording material to be passed has a small size and is continuously passed through the heating apparatus, an area (non-sheet passing area) other than a sheet-passing area at a fixation portion has been heated to a temperature higher than a fixation temperature of the toner image (overheating) to cause inside temperature rise or heat deterioration of the material to be heated.

In order to solve these problems, e.g., as described in JP-A Nos. Hei 09-171889, Hei 10-74009, and 2003-123957, it is effective to use a magnetic flux blocking means.

However, in such an electromagnetic induction heating-type heating apparatus provided with the magnetic flux blocking means, it is necessary to use a mechanism for changing a blocking area of the magnetic flux blocking means-depending on the size of the material to be heated and passed.

Further, as other means for preventing the temperature rise at the non-sheet passing portion, a lowering in sheet-passing speed (lowering in throughput) or abutment of heat dissipation means may be effected but is accompanied with such problems that a productivity of the machine is lowered and the addition of the heat dissipation means leads to a complicated apparatus and increase in production cost.

For this reason, as the countermeasure to prevent the non-sheet passing portion temperature rise, it has been known such a method that a Curie temperature of a electromagnetic induction heating member is set to be near to a fixation temperature, so that the temperature of the electromagnetic induction heating member is limited up to the Curie temperature to prevent overheating (temperature rise exceeding the Curie temperature).

Further, from the viewpoints of recent demands on energy saving and quick start-up time, the electromagnetic induction having member of the electromagnetic induction heating-type heating apparatus has been made thinner in order to provide a low amount of heat. For this reason, it can be considered that the thickness of the electromagnetic induction heating member is smaller than a depth δ of penetration of magnetic lines of force after the temperature of the heating member reaches a Curie temperature thereof. In this case, as shown in FIG. 5(*b*), magnetic lines of force F generated from a magnetic field generation means penetrate an electromagnetic induction heating member 1 and leak out. This leakage magnetic flux F' does not affect the outside of the heating apparatus but in the case where signal lines or other members which are liable to be damaged by heat generation are disposed in the neighborhood of the heating member 1, it is necessary to take a distance or magnetic flux blocking into consideration. As a result, the resultant heating apparatus becomes a large size or is increased in complexity.

DISCLOSURE OF THE INVENTION

An object of the present invention is to provide a heating apparatus, of an electromagnetic induction heating type, in which leakage magnetic flux is reduced at a portion where a temperature of a heating element reaches a Curie temperature of the heating element to eliminate the influence of the leakage magnetic flux on electrical parts and the like disposed in the neighborhood of the heating element.

Another object of the present invention is to provide a heating apparatus, of an electromagnetic induction heating type, in which a thickness of a heating element is small in an area corresponding to a conveyance area, of a minimum-sized material to be conveyed and heated, which is an area in which a temperature of the heating element does not reach a Curie temperature of the heating element to reduce an amount of heat of the entire heating element, thus permitting quick start-up time of a temperature of an electromagnetic induction heating member.

According to an aspect of the present invention, there is provided a heating apparatus, comprising:

a coil, and a heating element, containing the coil, which generates heat by the action of magnetic flux from the coil to heat an image on a material to be heated, wherein the heating element has a Curie temperature which is higher than a fixation temperature and is lower than a heat-resistant temperature of the heating apparatus and has a thickness, in an area outside an area corresponding to a predetermined size of the material to be heated, which is larger than a thickness in the area corresponding to the predetermined size of the material to be heated.

These and other objects, features and advantages of the present invention will become more apparent upon a consideration of the following description of the preferred embodiments of the present invention taken in conjunction with the accompanying drawings.

BEST MODE FOR CARRYING OUT THE INVENTION

The heating apparatus according to the present invention may preferably be used as a fixing apparatus for use in a copying machine, a printer, etc., in which an unfixed toner image is formed on a recording material to be conveyed and is heat-fixed thereon by the heating apparatus.

First Embodiment

Hereinbelow, an embodiment of the present invention will be described with reference to the drawings.

(1) Embodiment of Image Forming Apparatus

Figure 1:
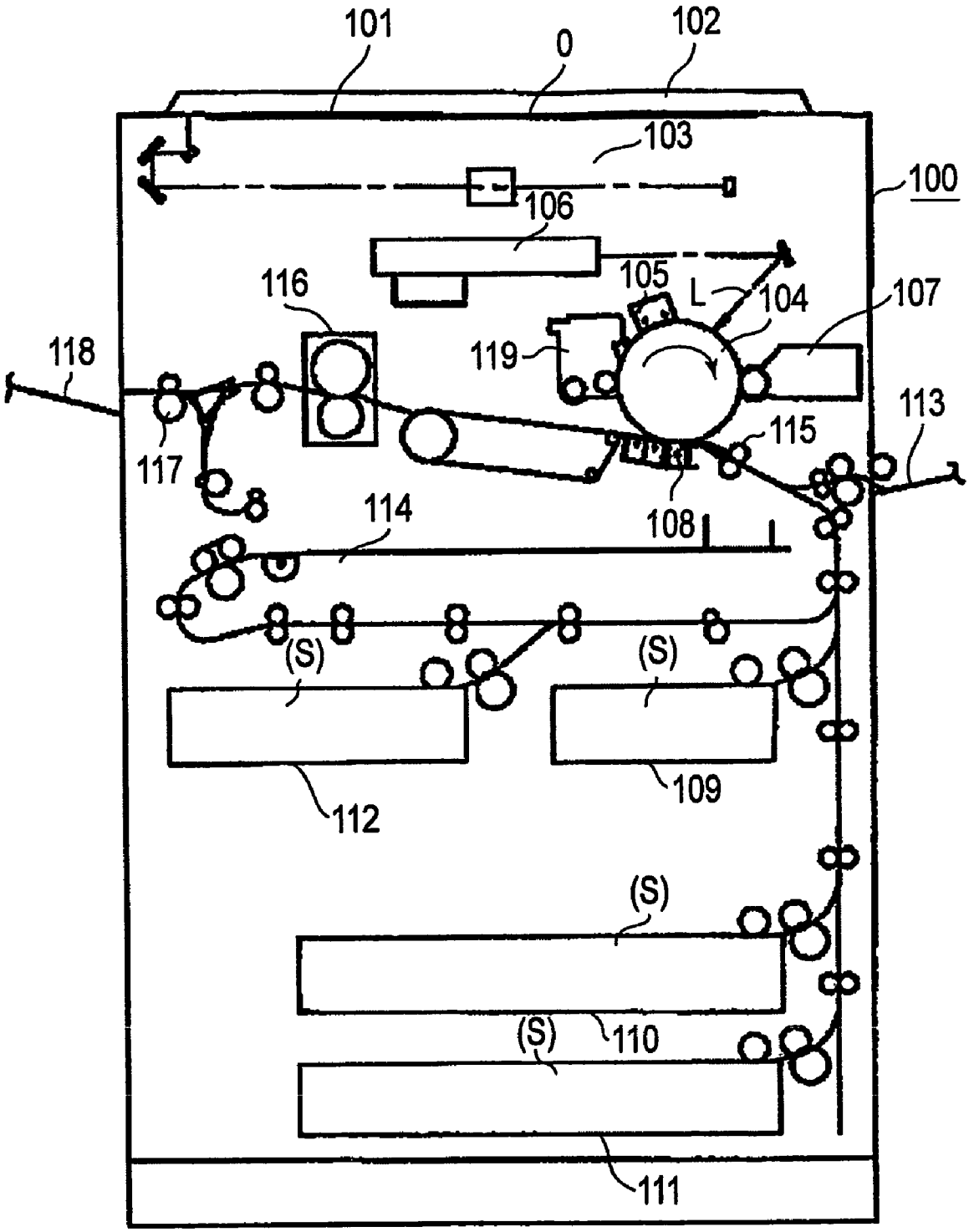
FIG. 1 is a schematic structural view of an image forming apparatus in First Embodiment.

FIG. 1 is a schematic structural view of an embodiment of an image forming apparatus provided, as an image heat-fixing apparatus with a heating apparatus of an electromagnetic induction heating type according to the present invention.

In this embodiment, an image forming apparatus 100 is a laser scanning exposure-type image forming apparatus (a copying machine, a printer, a facsimile machine, a multi-functional machine of these machines, etc.) utilizing a transfer-type electrophotographic process.

On an original supporting glass plate 101, an original O is placed face-down in accordance with a predetermined mounting standard and is covered with an original pressing late 102. When a copy start key is pressed, an image photoelectric reader (reader unit) 103 including a moving optical system is actuated to perform photoelectric reading processing of image information on the downward image surface of the original O placed on the original supporting glass plate 101. It is also possible to effect automatic feed of the original O onto the original supporting glass plate 101 by mounting an original automatic feeder (ADF, RDF) on the original supporting glass plate 101.

A rotary drum-type electrophotographic photosensitive member (hereinafter referred to as a "photosensitive drum") 104 is rotationally driven in a clockwise direction of an indicated arrow at a predetermined peripheral speed. During the rotation, the photosensitive drum 104 is uniformly charged electrically to a predetermined polarity and a predetermined potential by a charging apparatus 105. The uniformly charged surface of the photosensitive drum 104 is exposed imagewise to light L by an image writing apparatus 106 to be reduced in potential at an exposure light part, whereby an electrostatic latent image corresponding to an exposure pattern on the surface of the photosensitive drum 104. The image writing apparatus 106 used in this embodiment is a laser scanner and outputs laser light L modulated in correspondence with time-series electric digital pixel signal for the original image information photoelectrically read by the photoelectric reader 103 in accordance with instructions from an unshown controller, thereby to scan, for exposure, the uniformly charged surface of the rotating photosensitive drum 104, thus forming an electrostatic latent image corresponding to the original image information.

Next, the electrostatic latent image is developed as a toner image with toner by a developing apparatus 107. The toner image is electrostatically transferred from the surface of the photosensitive drum 104 onto a recording material which has been supplied to a transfer portion T, of a transfer charging apparatus 108, opposite to the photosensitive drum 104 from a sheet (recording material) feeding mechanism portion at predetermined timing.

The sheet feeding mechanism portion of the image forming apparatus of this embodiment includes first to fourth sheet feeding cassette portions 109-112, a multi-purpose tray (MP tray) 113, and inversion sheet re-feeding portion 114, and from these portions, the recording material S is selectively fed to the transfer portion at predetermined timing through registration rollers 115.

The recording material S onto which the toner image has been transferred from the photosensitive drum 104 surface at the transfer portion is separated from the photosensitive drum 104 surface and conveyed to a fixing apparatus 116 by which an unfixed toner image is fixed on the recording material P, which is then discharged on an output tray 118 located outside the image forming apparatus by a discharge roller 117.

On the other hand, the surface of the photosensitive drum 104 after the separation of the recording material S is cleaned by a cleaning apparatus 119 so as to remove residual toner remaining on the photosensitive drum 105. The photosensitive drum 105 is then repetitively subjected to image formation.

In the case of double-sided copy mode, a recording material which has been subjected to one-sided copying and fed from the fixing apparatus 116 is introduced into an reversal sheet re-feeding portion 114 to be fed again to the transfer portion at which transfer of a toner image onto the other side of the recording material is performed. The resultant recording material is passed through again the fixing apparatus 116 to be discharged on the output tray 118 located outside the image forming apparatus by the discharge roller 117.

(2) Heating Apparatus (Fixing Apparatus) 116

Figure 2:
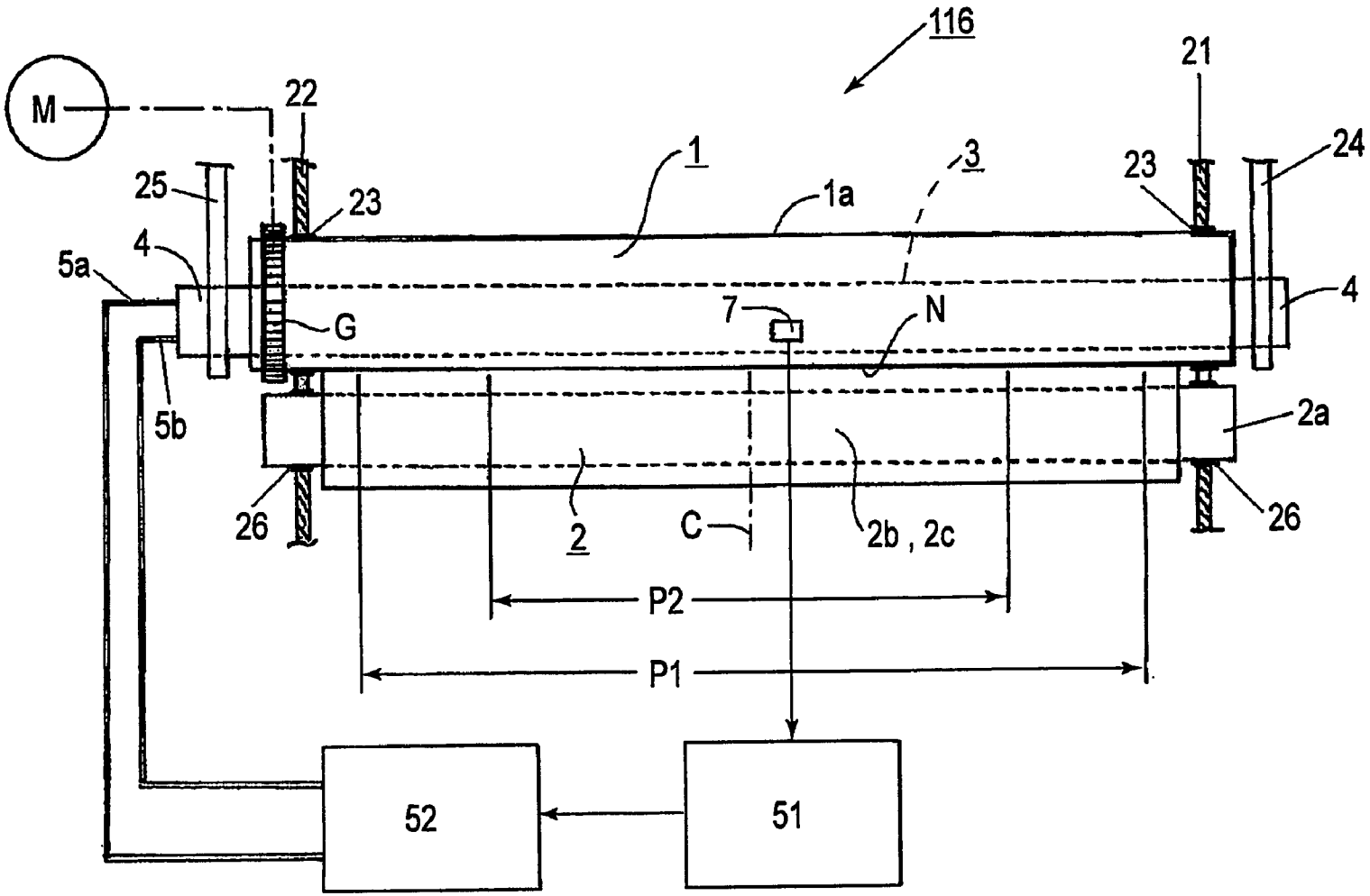
FIG. 2 is a schematic front view of a principal part of a fixing apparatus used in First embodiment.
Figure 3:
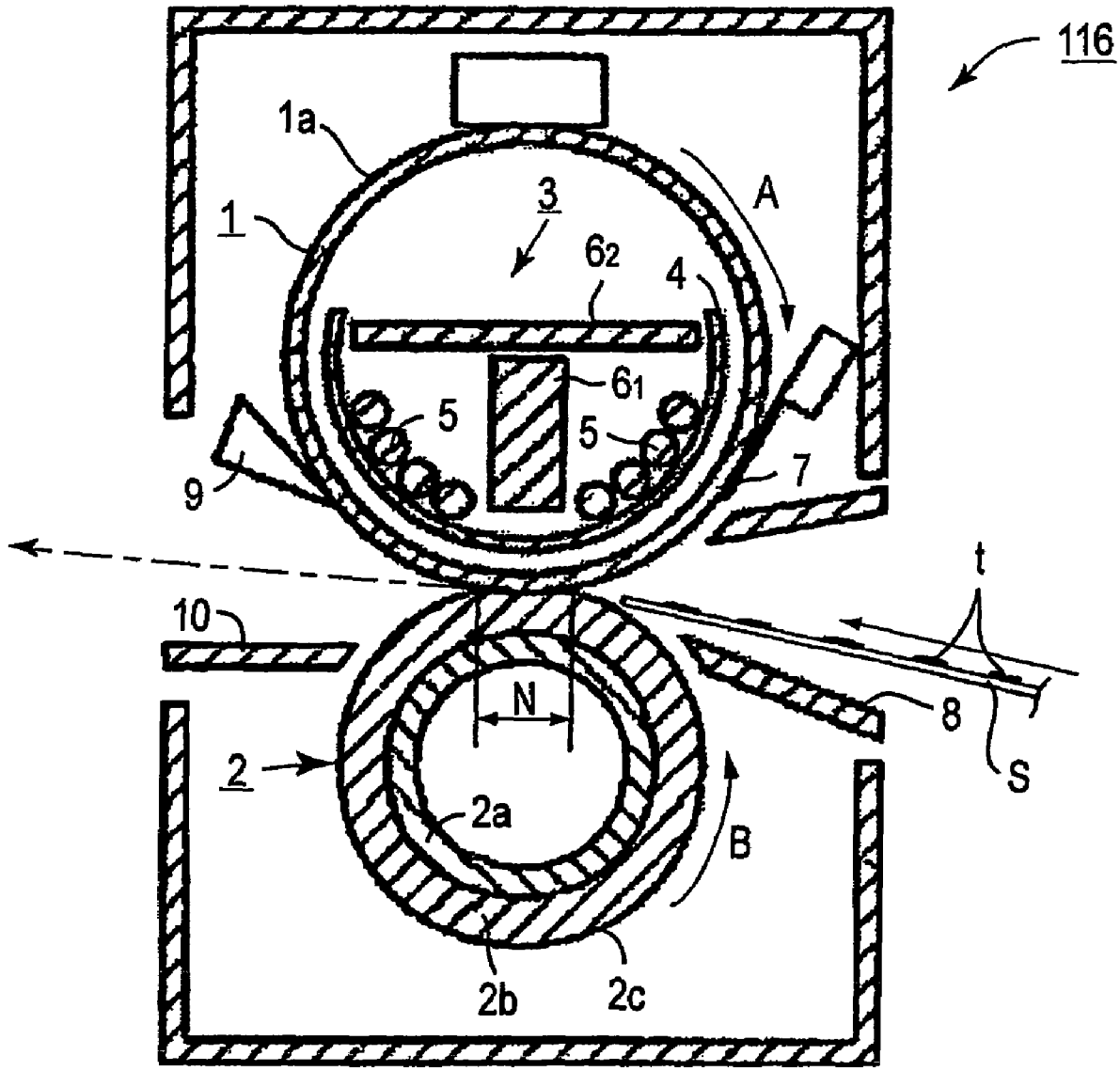
FIG. 3 is an enlarged schematic cross-sectional view of the fixing apparatus used in First Embodiment.

FIG. 2 is a front view of a principal portion of the fixing apparatus 116 and FIG. 3 is an enlarged cross-sectional view of the principal portion.

This fixing apparatus 116 is of a heating roller type and is a heating apparatus of an electromagnetic induction heating type. The fixing apparatus 114 principally includes a pair of heating roller 1 and a pressure roller 2 which are vertically disposed in parallel and pressed against each other to create a fixation nip portion N.

The heating roller (hereinafter referred to as a "fixation roller") 1 is a hollow (cylindrical) roller (electromagnetic induction heating member) which is formed with an induction heating element. At an outer peripheral surface of the roller, a toner release layer la is formed. In this embodiment, the toner release layer 1*a* is formed of PTFE in a thickness of 30 μm.

The fixation roller 1 is rotatably supported between side plates 21 and 22 (Located on the front and rear sides of the fixing apparatus) each via a bearing 23 at both end portions thereof. Further, at an inner hollow portion of the fixation roller 1, a heating assembly (exciting coil unit) 3 as a magnetic field (magnetic flux) generation means, is injected and disposed so that it is fixedly supported by holding members 24 and 25 located on the front and rear sides of the fixing apparatus in a non-rotation state.

The pressure roller 2 is an elastic roller including an iron core shaft 2*a*, a silicone rubber heat-resistant elastic layer which is integrally and concentrically wound around the iron core shaft 2, and a toner release layer 2*c* formed at an outer surface of the elastic layer 2*b*. The toner release layer 2*c* is similar to the toner release layer 1*c* of the fixation roller 1 described above. The pressure roller 2 is disposed under and in parallel with the fixation roller 1 and is rotatably held between the side plates 21 and 22 (located on the front and near sides of the fixing apparatus) each via a bearing 26 at both end portions thereof. The pressure roller 2 is further pressed against the lower surface of the fixation roller 1 by an unshown bias means while resisting an elasticity of the elastic layer 2*b*, thus forming the fixation nip portion N having the predetermined width.

Examples of the induction heating element constituting, as the electromagnetic induction heating member, the fixation roller 1 may include magnetic metals or alloys (electroconductors or magnetic materials) such as nickel, iron, ferromagnetic SUS, iron-nickel alloy, iron-nickel-chromium alloy, and nickel-cobalt alloy; and a magnetism-adjusted alloy which has been adjusted in a Curie temperature thereof, as desired, as described in JP-A No. 2000-39797. In this embodiment, an iron-nickel alloy having a Curie temperature (at which the alloy loses its magnetism) which has been set to 220° C. is used.

The Curie temperature is set to be smaller. than an acceptable upper limit and may, e.g., be set to be smaller than a heat-resistant temperature of apparatus parts so that the temperature of the heating apparatus (fixing apparatus) does not reach a heat-resistant temperature, such as an adhesive durability temperature between a roller core metal and a surface rubber layer of such a heating roller prepared by adhering a surface silicon rubber layer to the core metal in order to improve a fixing performance, or a heat-resistant temperature of a coating resin (material) for a coil disposed in the roller. The Curie temperature of the roller may be set to be lower than a temperature at which high-temperature offset is caused to occur.

The fixation roller 1 may preferably be formed of metal, such as iron, nickel or cobalt. By use of ferromagnetic metal (having high permeability, it is possible to confine a larger amount of magnetic flux generated from the magnetic field generation means within the ferromagnetic metal. In other words, it is possible to increase a magnetic flux density. As a result, eddy current is effectively produced at the surface of the ferromagnetic metal to generate heat. The toner release layer la at the surface of the fixation roller 1 may generally be formed of a 10-50 μm thick layer of PTFE or PFA. Further, it is also possible to provide a rubber layer disposed inside the toner release layer 1*a*.

The heating assembly 3 inserted into the hollow portion of the fixation roller 1 is the magnetic field generation means which is an assembly of a holder (outer casing) 4, an exciting coil 5, magnetic cores 61 and 62, etc. In the holder 4, the exciting coil 5 and the magnetic cores 61 and 62 are accommodated and held. The heating assembly 3 is inserted into the inner hollow portion of the fixation roller 1 to be placed in a position with a predetermined angle and in such a state it holds a predetermined gap between it and the fixation roller 1 in a noncontact manner, so that the heating assembly 3 is fixedly supported in a non-rotation manner by holding members 24 and 25 at both end portions thereof which are located on the front and rear sides of the fixing apparatus.

As a material for the holder 4, it is possible to suitably use heat-resistant and nonmagnetic materials, such as PPS-based resins, PEEK-based resins, polyimide resins, polyamide resins, polyamideimide resins, ceramics, liquid crystal polymer 5, and fluorine-containing resins.

The exciting coil 5 is required to generate a sufficient alternating magnetic flux for heating, so that it is necessary to provide a low resistance component and a high inductance component. As a core wire of the exciting coil 5, a litz wire comprising a bundle of about 80-160 fine wires having a diameter of 0.1-0.3 mm. The fine wires comprise an insulating electric cable. The fine wires are wound around the magnetic cores 61 and 62 plural times along the inner bottom shape of the holder 4 in an elongated board form, thus providing the exciting coil 5. The exciting coil 5 is wound in a longitudinal direction of the fixation roller 1 and held by the inner wall of the holder 4 and the magnetic cores, and further is provided with two lead wires (coil supply wires) 5*a* and 5*b* which are led outward and is connected to a power control apparatus (exciting circuit) 52.

A thermistor 7 as a temperature detection means for detecting the temperature of the fixation roller 1 is disposed so that it is caused to elastically contact the surface of the fixation roller 1 by pressing it against the fixation roller surface by use of an elastic member.

A detected temperature signal by the thermistor 7 is inputted into a control circuit 51. The temperature control means 7 is not limited to the thermistor but may be other temperature detection devices of a contact type or a noncontact type.

A guide plate 8 is disposed before the fixation roller 1 guides the recording material S, conveyed from an image forming mechanism to the fixing apparatus 116, to an entrance portion of the fixing nip portion N. A separation claw 9 functions as a mean for separating the recording material S from the fixation roller 1 by suppressing winding of the recording material S, which is introduced into and passed through the fixing nip portion N, around the fixation roller 1. A guide plate 10 is disposed after the fixation roller 1 guides the recording material S, which has been passed through the nip portion N, toward the output tray.

When a main power switch of the image forming apparatus is turned on, the control circuit 51 actuates a drive source (motor) M. A rotational driving force of the drive source is transmitted to a fixation roller gear G fixed at one end portion of the fixation roller 1 via a power transmission system, whereby the fixation roller 1 is rotationally driven in a clockwise direction of an arrow A at a predetermined peripheral speed as shown in FIG. 3. The pressure roller 2 is rotated by the rotation of the fixation roller 1 in a counterclockwise direction of an arrow B.

Further, the control circuit 51 actuates the power control apparatus 52 to supply electric power 5 (in this embodiment, a high-frequency current in the range of 10-100 kHz) from the power control apparatus 52 to the exciting coil 5 of the heating assembly 3 provided in the fixation roller 1 via the coil supply lines 5*a* and 5*b*.

As a result, by the action and magnetic flux (alternating magnetic field) generated from the heating assembly 3, the fixation roller 1 as the induction heating member generates heat (Joule heat by eddy-current loss). The temperature of this fixation roller 1 is detected by the thermistor 7, and the detected temperature signal is inputted into the control circuit 51. The control circuit 51 adjusts the fixation roller temperature by controlling the supplied power from the power control assembly 52 to the exciting coil 5 of the heating assembly 3 so as to be kept at a predetermined fixation temperature (in this embodiment, at 200° C.).

As described above, in such a state that the fixation roller 1 and the pressure roller 2 are rotationally driven and the fixation roller 1 is caused to generate heat by the power supply to the exciting coil 5 of the heating assembly 3 to be temperature-controlled to the predetermined temperature, the recording material S carrying thereon the unfixed toner image t which has been electrostatically transferred at the transfer portion of the image forming apparatus is introduced into the fixing nip portion N to be nipped and conveyed. During this nip conveyance process, the unfixed toner image t on the recording material S is fixed on the recording material surface as a permanent fixation image by the heat and the nip pressure.

(3) Overheating Prevention in Non-Sheet Passing Area of Fixing Apparatus.

Figure 5:
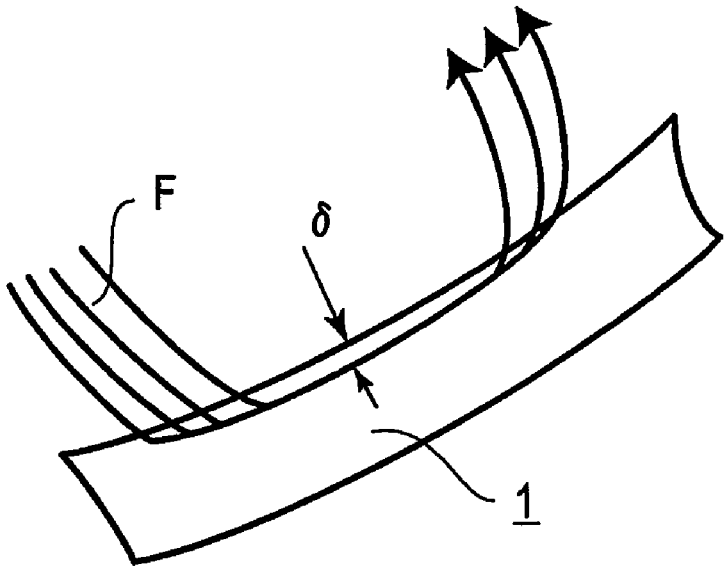
FIG. 5(*a*) is a schematic view for illustrating a state of working magnetic lines of force when a temperature of an electromagnetic induction heating member is smaller than a Curie temperature of the heating member, and FIG. 5(*b*)is a schematic view for illustrating a state of the magnetic lines of force when the temperature of the heating member is not smaller than the Curie temperature.
Figure 5:
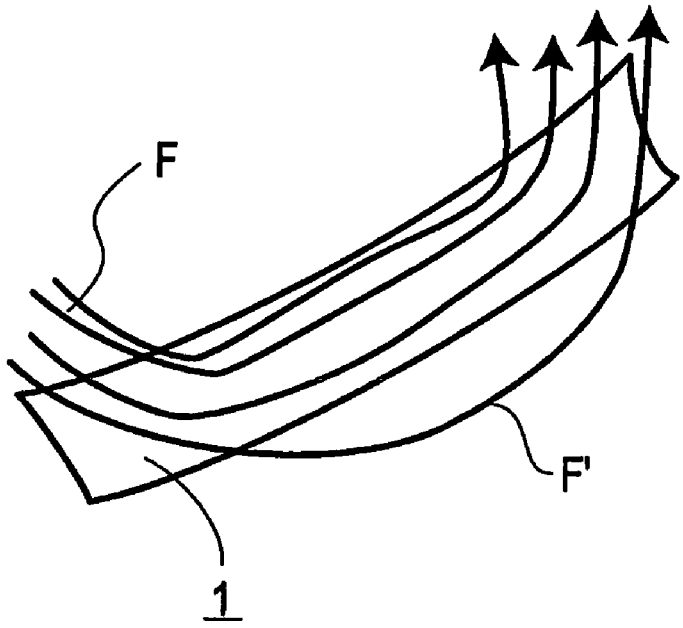

The fixation roller 1 is temperature-controlled by the thermistor 7 at 200° C. at its surface, so that the fixation roller temperature does not exceed the above described Curie temperature of 220° C. in the sheet passing area during standby or sheet passing. In this state, the magnetic lines of force F generated from the magnetic field generation means concentrate on the surface portion of the fixation roller 1, which is the induction heating element, as shown in FIG. 5(*a*) and pass along the surface portion while exponentially losing its density as they penetrate the inside of the induction heating element 1 (skin effect).

Here, a depth at which a magnetic flux density is reduced down to 0.368 time that the surface of the fixation roller 1 is referred to as a penetration depth δ which is generally represented by the following equation:

$$\delta=(\Pi\times f\times\mu\times\sigma)^{-1/2},$$

wherein f represents a frequency of exciting current of the magnetic field generation means, μ represents a permeability of the induction heating element, and σ represents an electric conductivity of the induction heating element.

A skin resistance Rs is represented by: Rs=Π/δ (Π: specific resistance). The fixation roller 1 is heated by the Joule heat by the skin resistance.

On the other hand, in the case where the small-sized paper is continuously passed, there is no heat loss to the sheets in the non-sheet passing area, so that the fixation roller 1 temperature is increased by the Joule heat described above. When the increased temperature of the fixation roller 1 reaches 220° C. as the Curie temperature of the fixation roller 1, the magnetism of the fixation roller 1 is lost (the permeability becomes 1).

In this case, the penetration depth 5 represented by the above described equation is quickly increased so that the skin resistance Rs is abruptly lowered. For this reason, when the fixation roller temperature reaches 220° C., subsequent heating of the fixation roller 1 is not effected. Thus, it becomes possible to suppress the non-sheet passing portion temperature rise at 220° C.

As described above, by setting the Curie temperature of the fixation roller 1 as the induction heating element to a predetermined value for temperature rise caused in the non-sheet passing portion (area), it becomes possible to the problems with respect to the non-sheet passing portion temperature rise without using complicated structure and lowering productivity.

More specifically, in this embodiment, the passing operation of the recording materials is performed in the fixing apparatus 116 on center reference conveyance. In FIG. 2, C represents a center reference line. In this embodiment, a maximum sheet passing width P1 is 320 mm and a minimum sheet passing width P2, which the sheet is conveyed at an ordinary throughput, is 150 mm.

The thermistor 7 as the temperature detection means for the fixation roller 1 is disposed so as to detect the surface portion of the fixation roller corresponding to a position in the area of the minimum sheet passing width P2. The control systems 51 and 52 including the thermistor 7 control the power supply to the exciting coil 5 so as to start up the fixation roller 1 to have a predetermined surface temperature (200° C. in this embodiment) in the area and temperature-control the fixation roller 1 to be kept at the temperature.

When a small-sized paper (having a sheet width which is not smaller than the minimum sheet passing width P2 and is smaller than the maximum sheet passing width Pl) is continuously conveyed, a temperature of the fixation roller 1 at a portion corresponding to the small-sized paper passing area of the fixation roller 1 is kept at 200° C. as the predetermined fixation temperature by temperature control with the control systems 51 and 52 including the thermistor 7. However, at a portion, of the fixation roller 1, corresponding to the non-sheet passing even which is a different area between the maximum sheet passing width P1 and the small-sized paper passing area, the fixation roller temperature is increased above 200° C. (the predetermined fixation temperature) due to the non-sheet passing portion temperature rise phenomenon.

In this embodiment, however, the Curie temperature of the fixation roller 1 as the electromagnetic induction heating member is set to 220° C., so that when the temperature at the fixation roller portion corresponding to the non-sheet passing area reaches 220° C., the magnetism of the fixation roller portion is abruptly lowered to prevent the fixation roller portion temperature from increasing above the Curie temperature of 220° C. In other words, the temperature rise in the non-sheet passing area is limited to the Curie temperature of 220° C. at the maximum, so that such a overheating that the temperature is further increased above the Curie temperature can be prevented.

(4) Setting of Thickness of Fixation Roller 1

Figure 4:
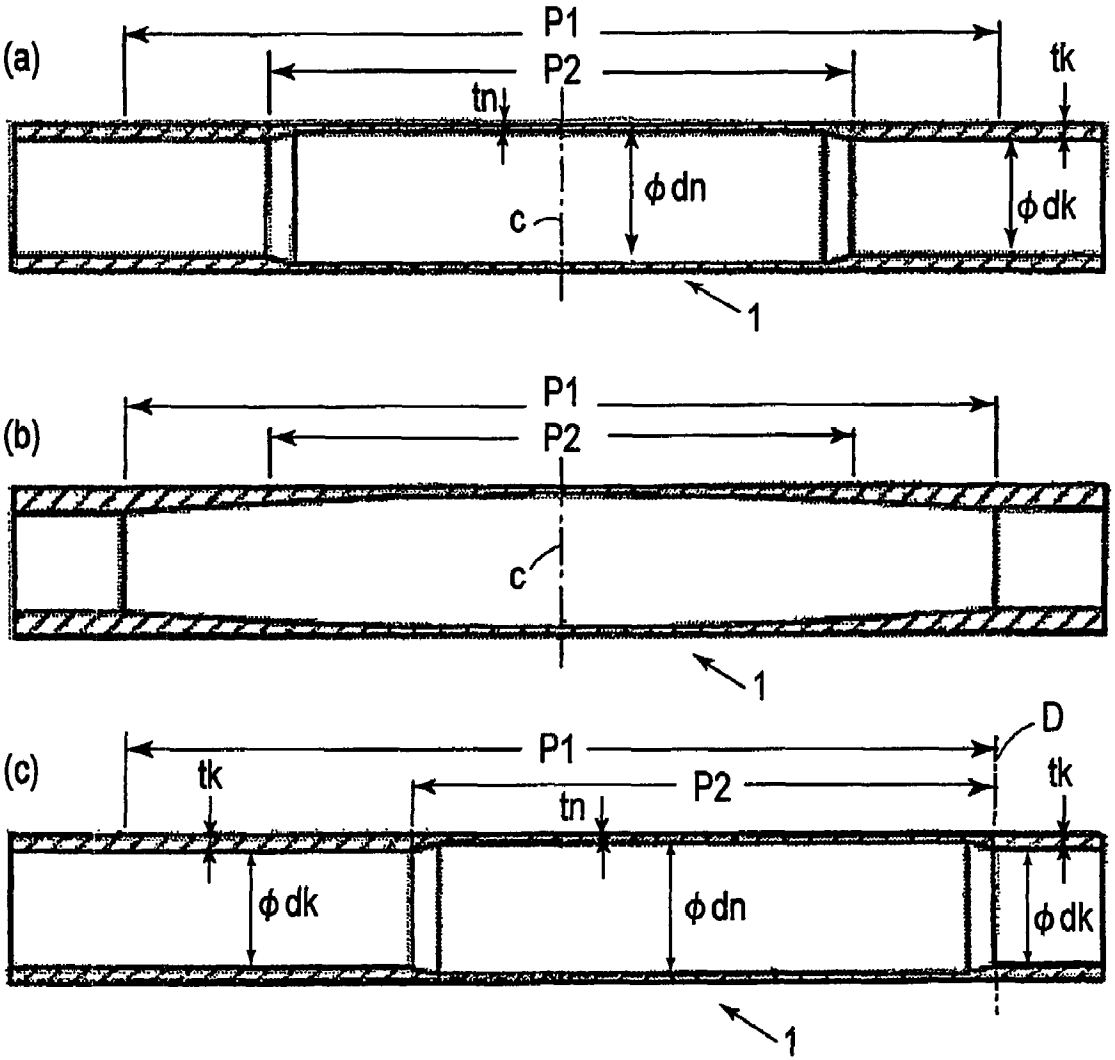
FIGS. 4(*a*), 4(*b*) and 4(*c*) are views each showing a thickness distribution of a fixation roller in a longitudinal direction.

A thicknesses distribution shape of the fixation roller 1 (as the electromagnetic induction heating member) in a longitudinal direction is shown in FIG. 4(*a*). With respect to the thickness of the fixation roller 1, a thickness tk of the fixation roller 1 in a Curie temperature attainment area (which is a differential area between the maximum sheet passing area P1, in which the fixation roller temperature reaches the Curie temperature due to the non-sheet passing portion temperature rise, and the sheet passing area of the small-sized paper having a sheet passing width which is not smaller than the minimum sheet width P2 and is smaller than the maximum sheet width P1, is set to be larger than a thickness Tn of the fixation roller 1 at a portion corresponding to an area of the minimum sheet width P2 in which the fixation roller temperature is always kept at the predetermined fixation temperature of 200° C. by temperature control so as not to reach the Curie temperature.

In this embodiment, as described above, the Curie temperature (magnetism loss temperature) of the fixation roller 1 is set to be 220° C. by setting, e.g., a mixing ratio between iron and nickel. A permeability μ before the fixation roller temperature reaches the Curie temperature if $100\times4\Pi\times10^{-7}$ (H/m) and a permeability μp after the fixation roller temperature reaches the Curie temperature is $4\Pi\times10^{-7}$ (H/m). Further, an electric conductivity σ is $1.3\times10^{6}$ (S/m).

In this embodiment, by changing the inner surface shape of the fixation roller 1, the thickness tn in the P2 area is smaller than the thickness tk in the area not smaller than the minimum sheet width P2 and is smaller than the maximum sheet width P1, is set to be larger than a thickness tn of the fixation roller 1 at a portion corresponding to an area of the minimum sheet width P2 in which the fixation roller temperature is always kept at the predetermined fixation temperature of 200° C. by temperature control so as not to reach the Curie temperature. In other words, the thickness of the roller in an area outside an area corresponding to a predetermined-sized paper is larger than that in the area corresponding to the predetermined-sized paper.

Herein, the "area corresponding to the predetermined-sized paper" means not only an area having a width of the predetermined-sized paper but also an area having a corresponding width which can be appropriately changed depending on a temperature rise area determined by intersection of paper passing area, a material for the roller, and a conveyance speed.

Further, in this embodiment, the predetermined-sized paper has a size smaller than the maximum conveyable size but may also have a size equal to the maximum conveyable size. In the latter case, it is possible to reduce magnetic flux leakage in an area other than the maximum sheet conveyance area.

In this embodiment, as described above, the Curie temperature (magnetism loss temperature) of the fixation roller 1 is set to be 220° C. by setting, e.g., a mixing ratio between the iron and nickel. A permeability μ before the fixation roller temperature reaches the Curie temperature is $100\times4\Pi\times10^{-7}$ (H/m) and a permeability μq after the fixation roller temperature reaches the Curie temperature is $4\Pi\times10^{-7}$ (H/m). Further, an electric conductivity σ is $1.3\times10^{6}$ (S/m).

In this embodiment, by changing the inner surface shape of the fixation roller 1, the thickness tn in the P2 area is smaller than the thickness tk in the area located outside the P2 area. In this embodiment, the thickness tn is 0.5 mm, and the thickness tk is 1.5 mm.

Further, the fixation roller 1 has an outer peripheral surface having a slight reverse-camber shape (diameter difference of about 100 μm) from the viewpoint of, e.g., sheet wrinkle prevention during the sheet conveyance operation.

The fixation roller 1 is temperature-controlled to have a surface temperature of 200° C. by the thermistor 7, so that the fixation roller temperature does not exceed the Curie temperature of 220° C. in the sheet passing area at the time of standby and sheet-passing. For this reason, the magnetic lines of force generated from the magnetic field generation means 3 penetrate the fixation roller 1 by a penetration depth δ represented by an equation shown below to pass through the inside of the fixation roller 1.

$$\delta = (\Pi\times f\times\mu\times\sigma)^{-1/2}$$
$$= 0.00014\,(\mathrm{m})$$
$$= 0.14\,(\mathrm{mm}),$$

wherein f represents a frequency of exciting current of the magnetic field generation means, μ represents a permeability of the induction heating element, and σ represents an electric conductivity of the induction heating element.

A skin resistance Rs is represented by: Rs=Π/δ (Π: specific resistance). The fixation roller 1 is heated by the Joule heat by the skin resistance.

On the other hand, in the case where the small-sized paper is continuously passed, there is no heat loss to the sheets in the non-sheet passing area, so that the fixation roller 1 temperature is increased by the Joule heat described above. When the increased temperature of the fixation roller 1 reaches 220° C. as the Curie temperature of the fixation roller 1, the magnetism of the fixation roller 1 is lost. More specifically, a permeability becomes $4\Pi\times10^{-7}$. In this case, the penetration depth δ is quickly increased to satisfy the following equation:

$$\delta = (\Pi\times f\times\mu q\times\sigma)^{-1/2}$$
$$= 0.0014\,(\mathrm{m})$$
$$= 1.4\,(\mathrm{mm}).$$

As a result, the skin resistance is abruptly lowered and when the fixation roller temperature reaches 220° C. (the Curie temperature), subsequent heating of the fixation roller 1 is not effected. Accordingly, it becomes possible to suppress the temperature rise in the non-sheet passing area at 220° C.

On the other hand, the thickness tk in the area outside the P2 area in which the fixation roller temperature reaches the Curie temperature when the small-sized paper is continuously passed is 1.5 mm, thus being larger than the penetration depth, of 1.4 mm, of the magnetic lines of force after the fixation roller temperature reaches the Curie temperature. Accordingly, even when the temperature of the fixation roller 1 reaches the Curie temperature at the time of continuously passing the small-sized paper, almost all the magnetic lines of force remain in the fixation roller 1. As a result, leakage of magnetic flux to the outside of the fixation roller is not substantially caused to occur. For this reason, e.g., it is possible to prevent an electromagnetic influence on signal lines connected to the control circuits and the like for controlling the temperature of the above described heating element.

Further, the thickness tn in the P2 area in which the fixation roller temperature does not reach the Curie temperature is thin (0.5 mm), so that a heat capacity of the entire fixation roller can be reduced. As a result, it is possible to realize, e.g., a quick start-up time of the fixation roller.

The change of the fixation roller thickness tn and tk is provided by changing corresponding inner diameters φdk of the fixation roller, so that the outer surface shape of the fixation roller may be provided as a desired shape suitable for sheet conveyance. As a result, there is no adverse effect on the sheet conveyance. Consequently, it is possible to achieve both the effects of preventing the above described leakage magnetic flux and the lowering in heat capacity of the fixation roller.

Further, similar effects can also be expected in the case of employing such a thickness distribution shape that the thickness is continuously changed as shown in FIG. 4(*b*), different from the stepwise change shape shown in FIG. 4(*a*). Further, in the case where the sheet conveyance is performed by one side reference conveyance, as shown in FIG. 4(*c*), the change in thickness distribution shape may be provided on the basis of positions of sheets of respective sizes. In FIG. 4(*c*), D represents a one side reference line.

In this embodiment, the thickness tk at the portion corresponding to the non-sheet passing portion of the fixation roller is set to be larger than the penetration depth after the fixation roller temperature reaches the Curie temperature but even when such a thickness relationship is not satisfied, an attenuation effect of the magnetic flux can be achieved exponentially with respect to the thickness. For this reason, even when the thickness is not larger than the penetration depth, a larger effect can be attained so long as the thickness is made larger.

Further, in the case of heating apparatuses used in an actual market, there are various paper (sheet) sizes, so that the thickness of fixation roller does not need to be changed clearly in correspondence with the sheet passing portion and the non-sheet passing portion. In the case where the thickness at the non-sheet passing portion causing the temperature rise is larger than the thickness at the central portion of the sheet passing area at least when the small-sized paper is passed, it is possible to attain the magnetic flux leakage reduction effect. From the viewpoint of this effect, in a preferred embodiment, the thickness of the fixation roller in the non-sheet passing area is larger than that in the minimum-sized sheet passing area. As a result, the magnetic flux leakage reduction effect can be achieved with respect to all the papers.

Second Embodiment

Figure 6:
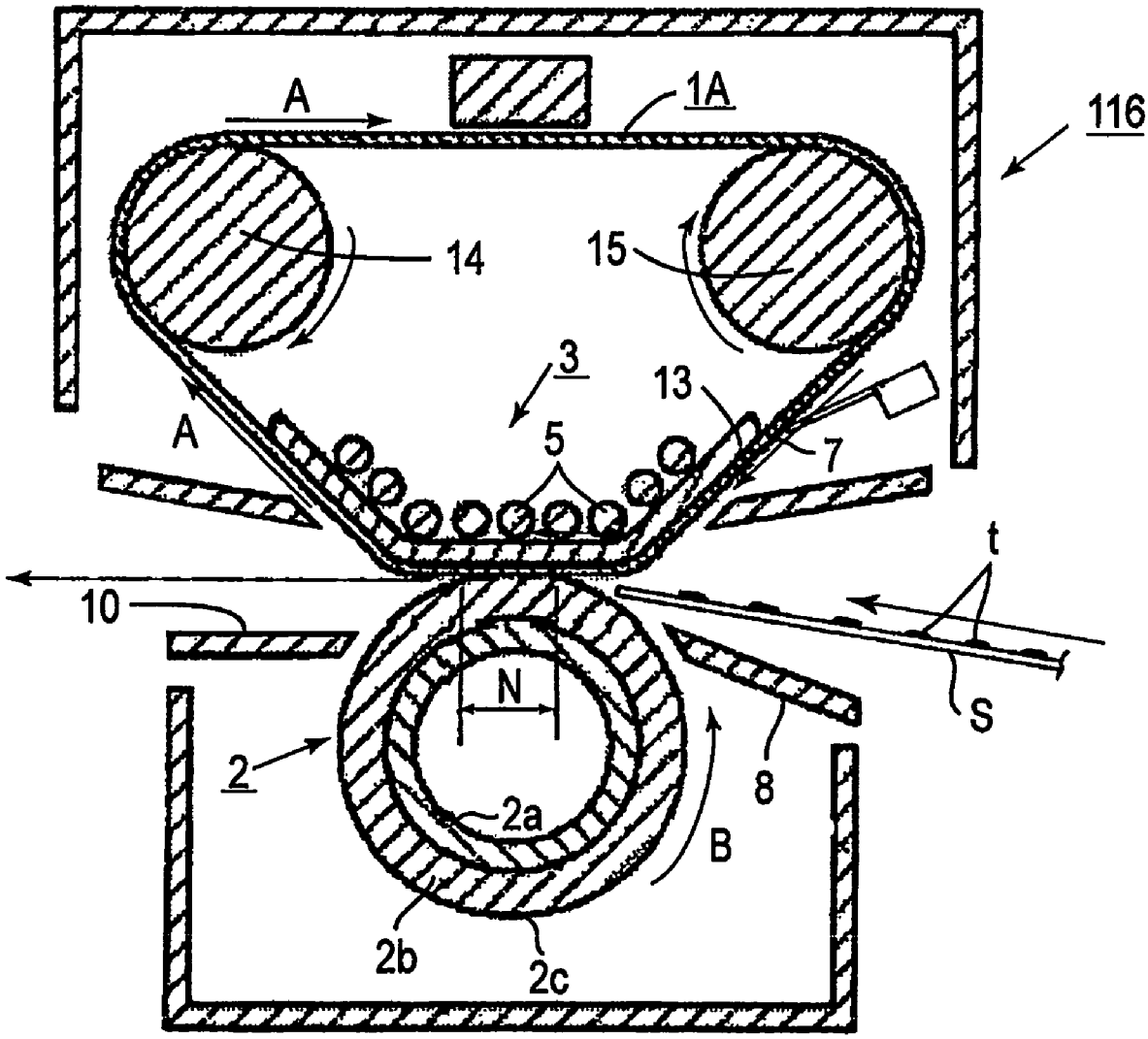
FIG. 6 is an enlarged schematic cross-sectional view of a fixing apparatus used in Second Embodiment.

FIG. 6 is a schematic sectional view of a fixing apparatus 116 as the heating apparatus of an electromagnetic induction heating type according to the present invention.

In this embodiment, the fixing apparatus 116 has the same structure as the fixing apparatus 116 (shown in FIG. 3) used in First Embodiment except that the fixation roller 1 is changed to a flexible fixation film 1A.

As shown in FIG. 6, a film guide member 13 and an exciting coil 5 are integrally disposed as a heating assembly 3, and an endless belt-like fixation film 1A as an electromagnetic induction heating member is extended under tension around the film guide member 13, a drive roller 14, and a tension roller 15. A lower surface portion of the film guide member 13 of the heating assembly 3 and an elastic pressure roller 2 to be rotated by movement of the fixation film 1A are pressed against each other via the fixation film 1A to form a fixing nip portion N. By center reference conveyance, a recording material S is introduced into the fixing nip portion N and then is nipped and conveyed to fix an unfixed toner image t on the recording material S by electromagnetic induction heating and nip pressure. Other structural members and structures of temperature control systems are identical to those for the fixing apparatus 116 of First Embodiment.

Figure 7:
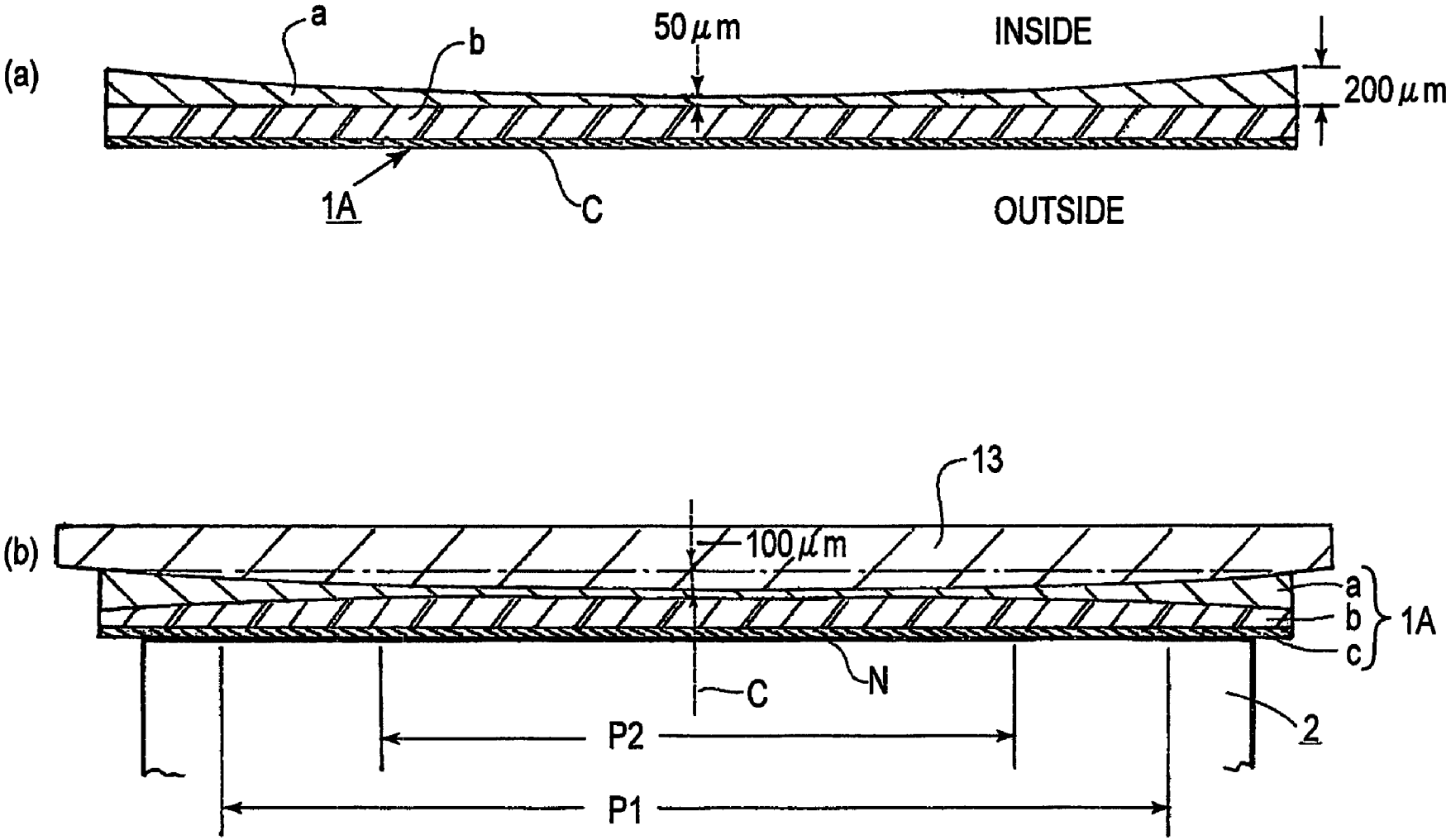
FIG. 7(*a*) is a schematic view showing a layer structure of a fixation film, and FIG. 7(*b*) is a schematic longitudinal cross-sectional view showing a state of a fixation nip portion.

As shown in FIG. 7(*a*) which is an enlarged cross-sectional view in a longitudinal direction (perpendicular to a sheet passing direction), the fixation film 1A has such a layer structure that a surface of an induction heating element layer a of iron-nickel alloy is coated with a 200 μm-thick elastic layer b of silicone rubber and further coated with a 30 μm-thick release layer c of fluorine-containing resin. The induction heating element layer a has a thickness of 50 μm at a longitudinal center portion and 200 μm at an end portion so that the thickness is gradually changed in the longitudinal direction.

The induction heating element layer a is formed with a magnetism-adjusted alloy so as to have a Curie temperature of 220° C. In the case of continuously passing the small-sized paper through center reference conveyance, a portion of the induction heating element layer a corresponding to the non-sheet passing portion has a temperature which reaches 220° C. but is not increased above 220° C. As a result, temperature rise (overheating) at the non-sheet passing portion at the time of passing the small-sized paper is suppressed.

The fixing nip portion N is created by pressing the lower surface portion of the film guide member 13 and the follower rotation pressure roller 2 against each other via the fixation film 1A as shown in FIG. 7(*b*) which is a longitudinal cross-sectional view. The lower portion of the film guide member 13 has a downward convex shape so as to have a convex thickness of 100 μm at a center portion, whereby the thickness change shape of the fixation film 1A described above is canceled by the downward convex shape of the film guide member 13 so as to provide the fixation film 1A at the fixing nip portion N with a shape having a downward convex thickness of 50 μm suitable for sheet conveyance.

By using the above described fixation apparatus, similarly as in First Embodiment, it is possible to realize suitable paper (sheet) conveyance while reducing magnetic flux leakage at the time of temperature rise at the non-sheet passing portion by the thickness of the induction heating element layer a.

Other Embodiments

1) The heating apparatus of the electromagnetic induction heating type according to the present invention is not limited to be used as the image heat-fixing apparatus as in the above described embodiment but is also effective as a provisional fixing apparatus for provisionally fixing an unfixed image on a recording sheet or an image heating apparatus such as a surface modification apparatus for modifying an image surface characteristic such as glass by reheating a recording sheet carrying thereon a fixed image. In addition, the heating apparatus of the present invention is also effective as a heating apparatus for heat-treating a sheet-like member, such as a hot press apparatus for removing rumples of bills or the like, a hot laminating apparatus, or a hot-drying apparatus for evaporating a moisture content of paper or the like.

2) The induction heating member may be constituted by not only a single induction heating member or a multilayer member having two or more layers including an induction heating layer and other material layers of heat-resistant plastics, ceramics, etc.

3) The induction heating scheme of the induction heating member (element) by the magnetic field generation means is not limited to the internal heating scheme but may be an external heating scheme in which the magnetic flux generation means is disposed outside the induction heating member.

INDUSTRIAL APPLICABILITY

As described hereinabove, according to a heating apparatus of an electromagnetic induction heating type according to the present invention, in which leakage magnetic flux is reduced at a portion where a temperature of a heating element reaches a Curie temperature of the heating element to eliminate the influence of the leakage magnetic flux on electrical parts and the like disposed in the neighborhood of the heating element.

In the heating apparatus, a thickness of a heating element is small in an area corresponding to a conveyance area, of a minimum-sized material to be conveyed and heated, which is an area in which a temperature of the heating element does not reach a Curie temperature of the heating element to reduce an amount of heat of the entire heating element, thus permitting quick start-up time of a temperature of an electromagnetic induction heating member.

The invention claimed is:

1. An image heating apparatus comprising:

a coil for generating magnetic flux;

a heat generating member, including a heat generation layer which generates heat by the magnetic flux from said coil, for heating an image on a recording material; and control means for controlling energization to said coil so that a temperature of said heat generating member is an image heating temperature for heating the image on the recording material, wherein said heat generating member has a Curie temperature which is higher than the image heating temperature and is lower than a heat-resistant temperature of said image heating apparatus, and wherein a thickness of said heat generation layer at its center portion is smaller than a thickness of said heat generation layer at its end portion, and the thickness of said heat generation layer at its end portion is larger than a skin depth at the Curie temperature.

2. An apparatus according to claim 1, wherein the thickness of said heat generation layer at its center portion is smaller than the skin depth at the Curie temperature.

3. An apparatus according to claim 1, wherein the thickness of said heat generation layer at its center portion is larger than the skin depth at the image heating temperature.

4. An apparatus according to claim 1, further comprising a power source for supplying a high-frequency current to said coil, the high-frequency current having a frequency of 10 kHz-100 kHz.

5. An apparatus according to claim 1, wherein said heat generating member is a roller.

6. An apparatus according to claim 5, wherein the roller has an inner diameter at its end portion that is smaller than an inner diameter of the roller at its center portion.

7. An apparatus according to claim 5, wherein the roller has an outer diameter at its end portion that is larger than an outer diameter of the roller at its center portion.

8. An apparatus according to claim 1, wherein said heat generating member is a belt.

9. An apparatus according to claim 1, further comprising a temperature detecting member for detecting the temperature of said heat generating member, said control means controlling energization to said coil depending on an output of said temperature detecting member.

10. An apparatus according to claim 1, wherein said image heating apparatus further comprises a coil unit including said coil, said coil unit being provided inside said heat generating member.

11. An image heating apparatus comprising:

a coil for generating magnetic flux;

a heat generating member, including a heat generating layer which generates heat by the magnetic flux from said coil, for heating an image on a recording material; and control means for controlling energization to said coil so that a temperature of said heat generating member is an image heating temperature for heating the image on the recording material, wherein said heat generating member has a Curie temperature which is higher than the image heating temperature and is lower than a heat-resistant temperature of said image heating apparatus, and wherein a thickness of said heat generating layer at its center portion is smaller than a skin depth at the Curie temperature, and a thickness of said heat generation layer at its end portion is larger than the thickness of said heat generating layer at its center portion.

12. An apparatus according to claim 11, wherein the thickness of said heat generating layer at its end portion is larger than the skin depth at the Curie temperature.

13. An apparatus according to claim 11, wherein the thickness of said heat generation layer at its center portion is larger than the skin depth at the image heating temperature.

14. An apparatus according to claim 11, further comprising a power source for supplying a high-frequency current to said coil, the high-frequency current having a frequency of 10 kHz-100 kHz.

15. An apparatus according to claim 11, wherein said heat generating member is a roller.

16. An apparatus according to claim 15, wherein the roller has an inner diameter at its end portion is smaller than an inner diameter of the roller at its center portion.

17. An apparatus according to claim 15, wherein the roller has an outer diameter at its portion is larger than an outer diameter of the roller at its center portion.

18. An apparatus according to claim 11, wherein said heat generating member is a belt.

19. An apparatus according to claim 11, further comprising a temperature detecting member for detecting the temperature of said heat generating member, said control means controlling energization to said coil depending on an output of said temperature detecting member.

20. An apparatus according to claim 11, further comprising a coil unit including said coil, said coil unit being provided inside said heat generating member.

* * * * *